US006318713B1

(12) United States Patent
Levi

(10) Patent No.: US 6,318,713 B1
(45) Date of Patent: Nov. 20, 2001

(54) PORTABLE WORKBENCH

(75) Inventor: Roni Levi, Ha'Ayin (IL)

(73) Assignee: ZAG Industries Ltd., Rosh Ha'ayin (IL)

( * ) Notice: Subject to any disclaimer, the term of this patent is extended or adjusted under 35 U.S.C. 154(b) by 0 days.

(21) Appl. No.: 09/636,214

(22) Filed: Aug. 10, 2000

Related U.S. Application Data

(60) Provisional application No. 60/148,216, filed on Aug. 12, 1999.

(51) Int. Cl.[7] ..... B25B 1/02

(52) U.S. Cl. ..... 269/139; 269/17; 269/88; 269/901; 269/4; 206/216; 206/736

(58) Field of Search ..... 269/139, 17, 88, 269/4, 901; 206/216, 223, 372–373, 736

(56) References Cited

U.S. PATENT DOCUMENTS

| | | | | |
|---|---|---|---|---|
| 3,118,685 | | 1/1964 | Jordan . | |
| 4,571,740 | * | 2/1986 | Kirby et al. | 455/344 |
| 4,706,817 | * | 11/1987 | Greathouse | 206/545 |
| 5,224,531 | | 7/1993 | Blohm . | |
| 5,551,558 | * | 9/1996 | Bureau | 206/223 |
| 5,730,282 | * | 3/1998 | Bureau | 206/223 |
| 5,803,472 | * | 9/1998 | Lien | 206/216 |

* cited by examiner

*Primary Examiner*—Joseph J. Hail, III
*Assistant Examiner*—Lee Wilson

(74) *Attorney, Agent, or Firm*—Pillsbury Winthrop LLP

(57) ABSTRACT

A portable workbench, comprises a molded plastic base structure and a molded plastic upper work structure. Wheels and a transport handle are mounted on the base structure. The transport handle is constructed and arranged to be manually engaged to move the base structure between a) a storage operative position wherein the base structure is stabily supported on a horizontal surface and b) a storage transport position wherein the wheels rollingly contact the horizontal surface so that the base structure can be moved along the horizontal surface using the handle. The upper work structure is constructed and arranged to be supported on an upper portion of the base structure in a storage operative position. The upper work structure and the base structure cooperate when in the storage operative positions thereof to define a storage space. Releasable securing structure movable between a) a securing position wherein the upper work structure is fixedly secured to the base structure in the storage operative position thereof and b) a released position wherein the upper work structure can be moved with respect to the base structure from the storage operative position to allow access to the storage space is provided. The upper work structure defines a generally horizontal work surface when in the storage operative position thereof, the surface being constructed and arranged to support a workpiece. The upper work structure also embodies therein a clamping assembly for clamping a workpiece in fixed relation with respect to the work surface. An optional support structure is provided to mount the upper work structure in vertically spaced relatively above the base structure to raise the level of the work surface and of the clamping assembly for convenience.

17 Claims, 6 Drawing Sheets

PORTABLE WORKBENCH

This application claims priority from U.S. Provisional Patent Application Ser. No. 60/148,216, filed Aug. 12, 1999, the contents of which are incorporated by reference herein in their entirety.

FIELD OF THE INVENTION

The present invention is related to portable workbenches.

BACKGROUND OF THE INVENTION

Persons working in the construction trades and homeowners doing home remodeling or repair often do carpentry and similar types of work at the site of the construction or the repair. A variety of hand tools such as saws, hammers and the like are required for most jobs, and these tools must be carried to the work site. Hand tools are usually stored in and transported to the work site in a tool box. Most construction and repair jobs are easier and faster to perform if the worker has a stable and convenient work surface available. Because much construction and repair work is done on site and therefore outside of a workshop, a workbench is often carried to the work site. Although portable workbenches are widely available, they are usually bulky and heavy. Often, because of the size and weight of most portable workbenches, it is necessary for the worker to transport a tool box and a portable workbench to the work site separately, which adds to the inconvenience of and to the time required for, a particular job.

A need exists for a lightweight, durable workbench that is readily convertible between 1) a storage position in which it is easily transportable and provides storage space for storing and transporting hand tools and 2) an operative position in which it supports a workpiece.

SUMMARY OF THE INVENTION

An objective of the present invention is to meet the need expressed above. Accordingly, the invention provides a portable workbench comprising a molded plastic base structure and a molded plastic upper work structure. Wheels are rotatably mounted on the base structure and a transport handle is connected to the base structure. The transport handle is constructed and arranged to be manually engaged to move the base structure between a) a storage operative position wherein the base structure is stabily supported on a horizontal surface and b) a storage transport position wherein the wheels rollingly contact the horizontal surface so that the base structure can be moved along the horizontal surface using the handle. The upper work structure is constructed and arranged to be supported on an upper portion of the base structure in a storage operative position. The upper work structure and the base structure cooperate when in the storage operative positions thereof to define a storage space. The workbench also includes releasable securing structure to releasably secure the upper work structure to the base structure. The releasable securing structure is movable between a) a securing position wherein the upper work structure is fixedly secured to the base structure in the storage operative position thereof and b) a released position wherein the upper work structure can be moved with respect to the base structure from the storage operative position to allow access to the storage space. The upper work structure defines a generally horizontal work surface when it is in its storage operative position. The work surface is constructed and arranged to support a workpiece. The upper work structure embodies therein a clamping assembly for clamping a workpiece in fixed relation with respect to the work surface.

Optionally, a support structure can be provided to mount the upper work structure above the base structure. The support structure raises the level of the work surface on the upper work structure so that the work surface is at a convenient height for a user standing by the workbench. Accordingly, it is another object of the invention to provide a portable workbench comprising a molded plastic base structure, a molded plastic upper work structure having an upper surface constructed and arranged to support a workpiece and a support structure constructed and arranged to support the upper work structure on the base structure. The workbench is convertible between a) an extended operative position and b) a storage position. In the extended operative position, the support structure extends between the base structure and the upper work structure and mounts the upper work structure on the base structure in vertically upwardly spaced relation to the base structure so that the upper surface is disposed at a height which enables a user to comfortably work on a workpiece supported by the upper surface while the user is standing. In the storage position the upper work structure is secured to the base structure and cooperates with the base structure to define a storage space. The support structure is constructed and arranged to be carried in storing relation to the base structure and the upper work structure in the storage position. The workbench includes a handle that is constructed and arranged to be manually engaged to facilitate transporting the workbench when in the storage position.

Other objects, features, and advantages of the present invention will become apparent from the following detailed description, the accompanying drawings, and the appended claims.

DETAILED DESCRIPTION OF THE INVENTION

Figure 1:
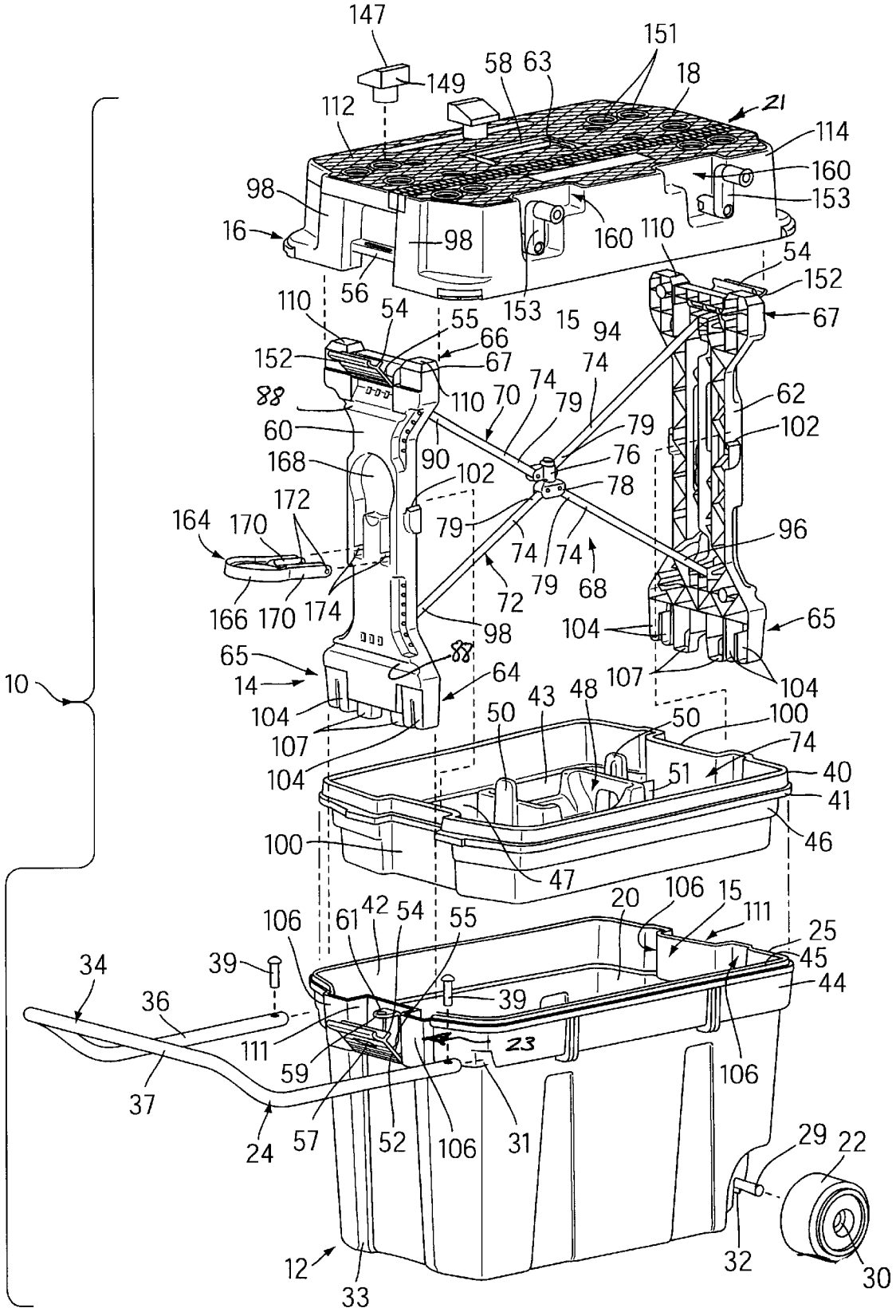
FIG. 1 is a partially exploded view of a workbench constructed according to the principles of the present invention.
Figure 2:
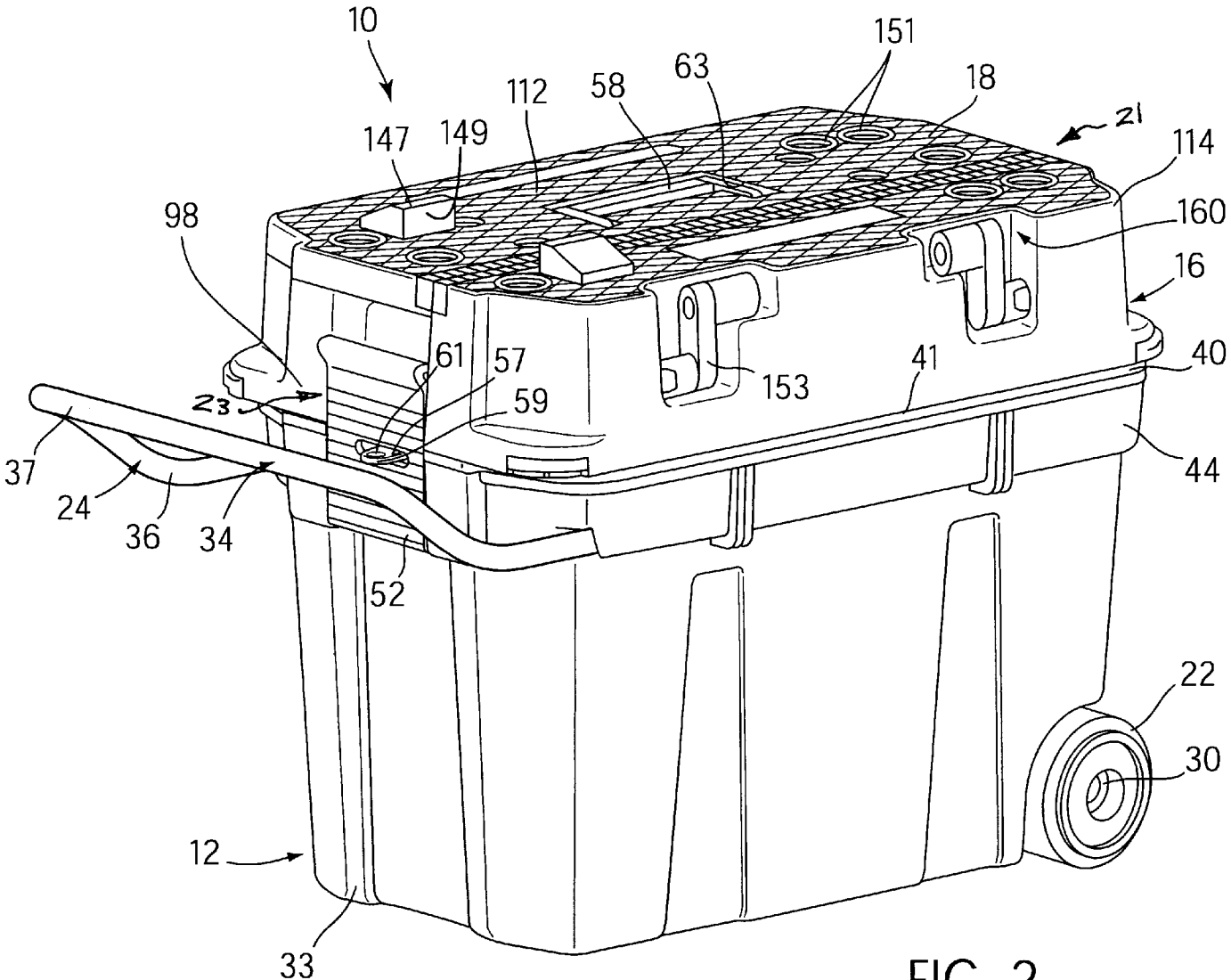
FIG. 2 shows the workbench of FIG. 1 in a storage operative position.
Figure 3:
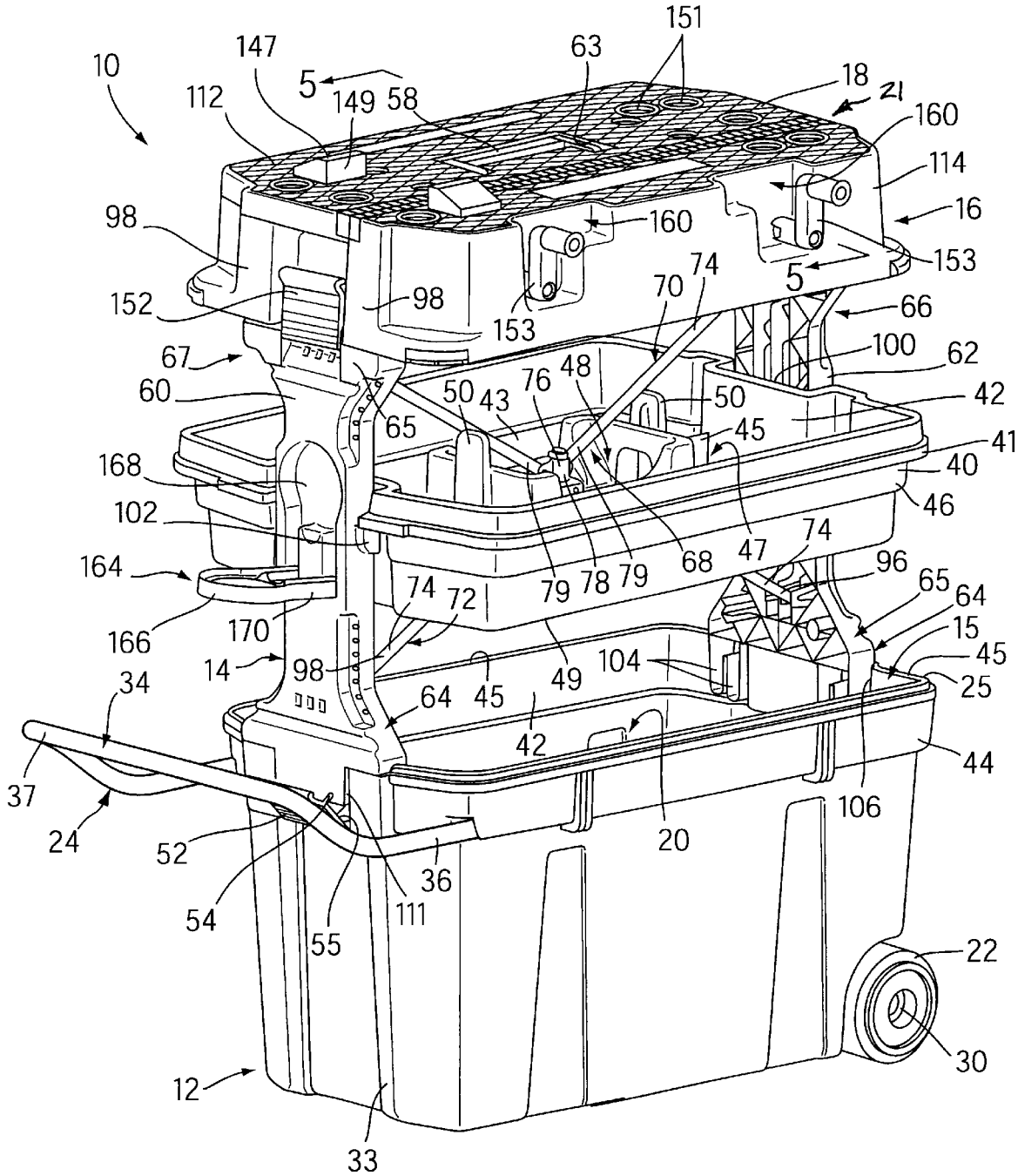
FIG. 3 shows the workbench of FIG. 1 in an extended operative position.

FIGS. 1–3 show an exemplary embodiment of a portable workbench, generally designated 10, constructed according to the principles of the present invention. The workbench 10 includes a molded plastic base structure 12 and a molded plastic upper work structure 16. Wheels 22 are rotatably mounted on the base structure 12 and a transport handle 24 is connected to the base structure 12. The transport handle 24 is constructed and arranged to be manually engaged to move the base structure 12 between a) a storage operative position (see FIG. 2) wherein the base structure 12 is stabily supported on a horizontal surface and b) a storage transport position (see FIG. 6) wherein the wheels 22 rollingly contact the horizontal surface so that the base structure 12 can be moved along the horizontal surface using the handle 24.

The upper work structure 16 is constructed and arranged to be supported on an upper portion of the base structure 12 in a storage operative position (as shown, for example, in FIG. 2). The upper work structure 16 and the base structure 12 cooperate when in the storage operative positions thereof to define a storage space 15.

The workbench 10 also includes releasable securing structure 23 to releasably secure the upper work structure 16 to the base structure 12. The releasable securing structure 23 is movable between a) a securing position (see FIG. 2, for example) wherein the upper work structure 16 is fixedly secured to the base structure 12 in the storage operative position thereof and b) a released position (see FIG. 1, for example) wherein the upper work structure 16 can be moved with respect to the base structure 12 from the storage operative position to allow access to the storage space 15. The upper work structure 16 defines a work surface 18 which is horizontally disposed when the upper work structure 16 is in its storage operative position. The work surface 18 is constructed and arranged to support a workpiece. The upper work structure 16 embodies therein a clamping assembly 21 for clamping a workpiece in fixed relation with respect to the work surface 18.

The workbench 10 optionally and preferably also includes a support structure 14. The support structure 14 is used to mount the upper work structure 16 in vertically spaced relation above the base structure 12 so that the upper work surface 18 on the upper work structure 16 is at a level that is comfortable for a user standing by the workbench 10. Thus, when the support structure 14 is included as part of the workbench 10, the workbench 10 is convertible generally between a) a storage position (FIGS. 2 and 6) and b) an extended operative position (FIG. 3). Generally, in the storage position, the workbench 10 provides a compact, easily transportable assembly that can be used to store a plurality of hand tools and work related supplies; and in the extended operative position, the workbench 10 provides a stable, sturdy and versatile structure for supporting a workpiece.

More particularly, in the storage position, the upper work structure 16 is removably secured to the base structure 12 in covering relation therewith and cooperates with the base structure 12 to define a storage space 15. The support structure 14 is constructed and arranged to be carried in storing relation to the base structure 12 and the upper work structure when the workbench 10 is in its storage position. Preferably, the support structure 14 is sized to fit within the storage space 15 for storage and transport when the workbench is in its storage position. The support structure 14 can also be stored for transport by securing the support structure 14 to a transport handle 24 of the workbench 10 (see FIG. 6).

The structural details of the workbench 10 can be appreciated from FIGS. 1–5. The base structure 12 is preferably made of a suitable molded plastic and provides a large storage compartment 20 (FIG. 1) which provides a portion of the storage space 15. Preferably another portion of the storage space 15 is provided by the underside recess formed by the upper work structure 16. A pair of wheels 22 are rotatably mounted on one end of the base structure 12 and a transport handle 24 is mounted on the opposite end of the base structure 12. The handle 24 is manually engageable and is constructed to facilitate rolling transport of the workbench 10 on the wheels 22, particularly when the workbench 10 is in its storage position. Preferably the each wheel 22 is a molded plastic structure reinforced by wheel ribs (not shown) and each is mounted on an end of an elongated axle 29 by two hubs 30 or other appropriate means. The axle 29 is preferably an elongated cylindrical steel shaft and is snap fit into rotational engagement with a pair of downwardly opening U-shaped slots 32 integrally formed in the molded plastic of the base structure 12. Alternatively, the axle 29 can be mounted to the base structure 12 through a pair of axially aligned through-holes formed in the base structure 12.

Figure 6:
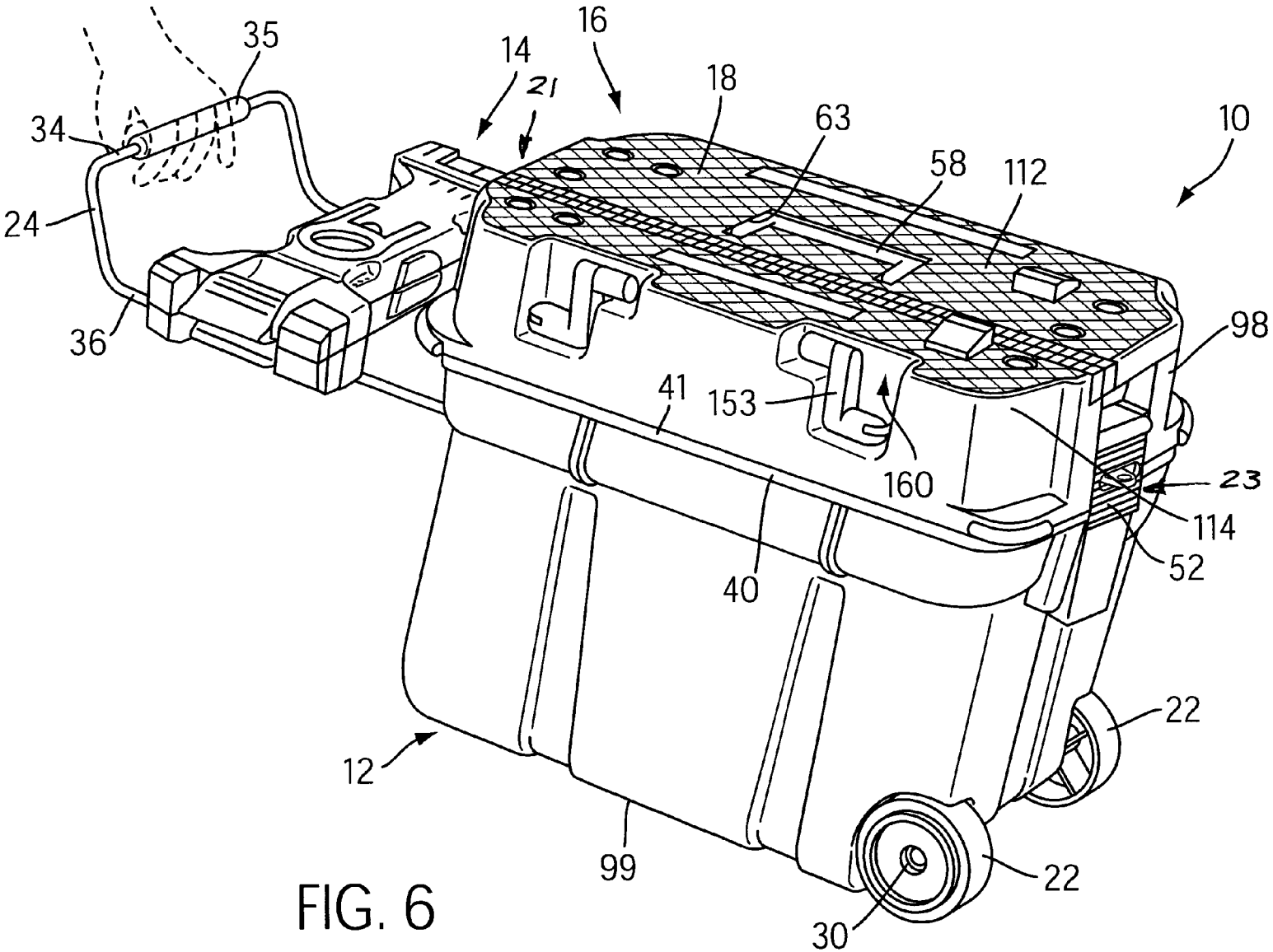
FIG. 6 is a perspective view of the workbench in its storage transport position showing the support structure in a storage position thereof carried by a handle on the workbench.

The transport handle 24 is an essentially U-shaped member. The handle 24 is preferably a tubular structure and made of a lightweight metallic material such as aluminum, but may also be a solid (i.e., non-tubular) structure and may be made of a plastic or other suitable material. The handle 24 includes a grippable portion 34 (formed by the bight portion of the U-shaped member) and two legs 36 extending outwardly from opposite ends of the bight portion 34. In the preferred embodiment of the workbench 10, a free end portion of each leg 36 is movably engaged with the base structure 12 for transport handle 24 movement between a retracted storage position (not shown) and an extended position (FIGS. 2, 3 and 6). Specifically, preferably the free end of each leg 36 is slidably mounted in elongated passages 31 formed on opposite sides of the base structure 12. A grippable structure 35 (shown, for example, in FIG. 6) may optionally be provided on the transport handle 24 to protect and cushion the user's hand (shown in dashed lines).

In the retracted storage position, the legs 36 are disposed in the passages 31 in the base structure 12 and the bight portion 34 is positioned against or is spaced slightly from the adjacent side 33 of the base structure 12 so that the transport handle 24 does not protrude from the base structure 12. This is particularly advantageous when the workbench 10 is in its extended operative position or in the storage operative position and the user is using the workbench 10 to support a workpiece. In the extended position, the legs 36 are moved outwardly of the passages 31 so that the bight portion 34 of the transport handle 24 is spaced outwardly from the side 33 of the base structure 12. The outward sliding movement of the handle 24 is limited by stopping pins 39 mounted on the free ends of the legs 36. Preferably the outer portions of the legs 36 are angled upwardly (from the point of view of, for example, FIG. 3) so that a central grippable portion 37 of the extended handle 24 can be comfortably grasped (while the user is still standing generally erect) to roll the workbench 10 on its wheels. The contour of the handle 24 provided by the upwardly angled outer leg portions also allows the user to stand essentially erect while rolling the workbench 10 in its storage transport position (FIG. 6) without tipping the workbench 10 excessively during rolling movement.

Alternatively, the transport handle 24 can be rigidly and immovably mounted to the base structure 12 in the transport handle extended position so that the handle 24 is not movable with respect to the base structure 12.

The workbench 10 includes a tool holding tray 40. Preferably the tool holding tray 40 is an integral structure constructed of a suitable molded plastic. The tool holding tray 40 is constructed and arranged to fit within the storage space 15 when the workbench 10 is in its storage position, and to be mounted above the base structure 12 (FIG. 3) when the workbench 10 is in its operative position (in a manner considered below). An upper wall portion 44 of the base structure 12 is shaped to form an upper interior recess 42 that is sized to receive a lower portion 46 of the tool holding tray 40. The upper wall portion 44 extends around the entire upper periphery of the base structure 12. Preferably, the tool holding tray 40 has a peripheral flange 41 that can rest along the upper edge 45 of the base structure 12 when the tool holding tray 40 is disposed in the recess 42.

The interior recess 42 in the base structure 12 is provided so that the tool holding tray 40 can be held immovably with respect to the base structure 12 in a portion of the storage space 15 when the workbench 10 is in its storage position, with the peripheral flange 41 resting on the upper edge 45 of the base structure 12. In another preferred embodiment, the tool holding tray 40 is sufficiently small to fit entirely within the storage compartment 20 and rest on the bottom floor of the compartment 20 when the workbench 10 is in its storage position.

When the workbench 10 is in its extended operative position (FIG. 3), the tool holding tray 40 can optionally be supported by resting its bottom surface on the top edge 45 of the base structure 12 in cross-wise fashion (i.e., rotated ninety degrees to the orientation of the base structure 12). This cross-wise configuration is not shown in the drawings. Alternatively, the tool holding tray 40 can be mounted on the support structure 14 as shown in FIG. 3, when in the operative position.

The top surface 43 of the tool holding tray 40 is shaped (preferably by molding) to include a plurality of integral vertically extending wall portions 51 that partition the tray 40 into a plurality of storage compartments, generally designated 47. The storage compartments 47 are of various sizes and shapes to hold small tools and other hardware. An elongated opening 48 is provided in the center of the tool holding tray 40 and a tray handle 50 is integrally formed in a central region of the tool holding tray 40 around the opening 48 to assist the workbench user in lifting and carrying the tool holding tray 40.

The upper work structure 16 is preferably made of a molded plastic and is constructed and arranged to fit in covering relation over both the base structure 12 and the tool holding tray 40 when the workbench 10 is in its storage position and the tool holding tray 40 is stored in the storage space 15. The releasable securing structure 21 is provided by a releasable latch 52 which is preferably made of a molded plastic and which is mounted at each end of the base structure 12 for movement between latched and unlatched positions to releasably latch the upper work structure 16 to the base structure 12.

Each releasable latch 52 includes integral locking members 54, 55 (see FIG. 1) that snap fit into locking engagement with respective latch engaging structure 56 (FIG. 1) integrally formed of the plastic on each side of the upper work structure 16. Each latch 52 is mounted on the base structure 12 and is provided with a central aperture 57. A flange 59 integrally formed with the base structure 12 extends through the aperture 57 of each latch 52 when the latch 52 is in the latched condition. The flange 59 has a bore 61 to receive a padlock or other suitable locking structure (not shown) to lock the workbench 10 in its storage position and to prevent access to the storage space 15 therein.

The upper work structure 16 includes a central handle 58 mounted to a central portion of the upper work structure 16 to enable the workbench 10 to be carried using the central handle 58 when in the storage position and the latches 52 are latched. The latches hold the upper work structure 16 on the base structure 12 while the workbench 10 in its storage position is being carried using the handle 58. The central handle 58 also enables the user to lift the upper work structure 16 off of the base structure 12 when the upper work structure 16 is unlatched from the base structure 12. The central handle 58 is movable between a central handle retracted position (see FIGS. 1–3) and a central handle extended position (not shown).

Preferably, when the central handle 58 is in its retracted position, the central handle 58 is disposed in a recess 63 in the upper work surface 18. In this position, the handle 58 is generally flush with the work surface 18. Thus, when the handle 58 is in its retracted position, it does not protrude from the upper surface 18 when the workbench is in its operative position to support a workpiece. When the handle 58 is in its extended position, the central handle 58 protrudes upwardly from the upper surface to allow the user to easily grasp the handle 58 to carry the workbench 10 in its storage position.

Generally, the support structure is constructed and arranged to be carried in storing relation to the base structure and the upper work structure when the workbench 10 is in its storage position. In the exemplary embodiment of the workbench 10, the support structure 14 can be stored either in the storage space or outside the storage space.

More particularly, as can be appreciated from FIG. 2, for example, the support structure 14 (not visible in FIG. 2) can be stored in the storage compartment 20 in the base structure 12 when the workbench 10 is in its storage position. The storage compartment 20, which forms part of the storage space 15 of the workbench 10, is large enough to contain (in addition to the support structure 14) a plurality of hand tools and supplies for storage and transport. As considered in detail below, when the workbench 10 user wishes to convert the workbench 10 from its storage position to its extended operative position, the user removes the support structure 14 from the storage space 15 and places the structure 14 in supporting relation between the base structure 12 and the upper work structure 16. The construction and operation of the support structure 14 can be best understood from FIGS. 1 and 4.

Alternatively, the support structure 14 can be mounted on the workbench outside the storage space when the workbench 10 is in its storage position. For example, the support structure 14 can be releaseably secured to the extended transport handle 24 as shown in FIG. 6.

As best appreciated from the partially exploded view of the workbench 10 in its operative position in FIG. 1, the support structure 14 includes a pair of elongated support members 60, 62, respectively. Each support member 60, 62 has connecting portions 64, 66 at respective opposite ends 65, 67 thereof for connecting to the base structure 12 at one of the ends (end 65) and for connecting to the upper work structure 16 at an opposite of the ends (end 67) when the workbench 10 is in its operative position (FIG. 3). The support members 60, 62 are preferably constructed of an appropriate molded plastic and are mounted for movement relative to one another between an open operative position (see FIGS. 1 and 3) and a closed retracted position (see FIGS. 4 and 6) by a pair of cross brace structures, generally designated 68.

The support structure 14 includes a pair of cross brace structures, including an upper cross brace structure 70 and a lower cross brace structure 72. Each cross brace structure 70,72 is movable between an extended and a retracted position and each cross brace structure 70, 72 is operatively engaged with the pair of support members 60, 62 such that when the support members are in their open operative positions, the cross brace structures are in their extended positions and when the support members are in their closed retracted positions, the cross brace structures are in their retracted positions.

Figure 4:
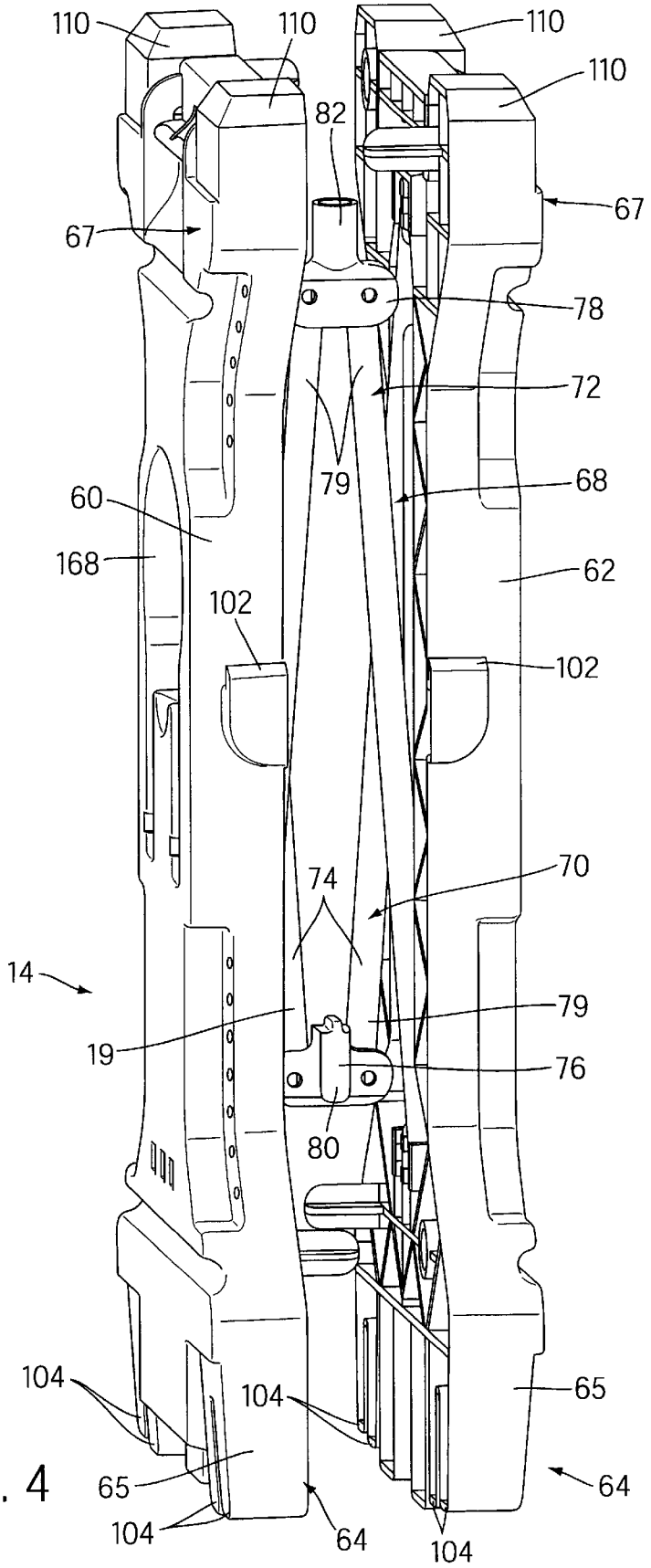
FIG. 4 is an isolated view of a support structure of the workbench showing the support structure in a retracted storage position.

More specifically, each cross brace structure 70, 72 is comprised of two elongated cross brace members 74. The cross brace members 74 of the upper cross brace structure 70 are pivotally connected at adjacent ends 79 to a connecting bracket 76, and have opposite ends pivotally connected to the upper end of a respective support member 60, 62. The cross brace members 74 of the lower cross brace structure 72 are pivotally connected at adjacent ends 79 to a connecting bracket 78, and have opposite ends pivotally connected to lower portions of the respective support members 60, 62. The cross brace members 74 move between extended and retracted positions thereby enabling the upper and lower cross brace structures 70, 72 (and thus the support structure 14) to move generally between their operative extended position (FIGS. 1 and 3) and retracted storage positions (FIG. 4).

The brackets 76, 78 include releasably interengagable structure 80, 82, respectively, constructed and arranged so that 1) when the structures 80, 82 are interengaged, they releaseably retain the two respective pairs of cross brace members 74 (of the cross brace structures 70, 72) in their operative extended positions and 2) when the structures 80, 82 are released from interengagement they allow the pairs of cross brace members 74 to be moved into their retracted positions, thereby enabling the support members 60, 62 to be moved into their closed retracted position.

The releasably interengagable tubular structure 82 on the bracket 78 is an elongated hollow cylindrical structure that is received within an opening (not shown) formed in the interengagable structure 80 of the bracket 76. The integral tubular structure 82 on the bracket 78 is constructed and arranged to be received within the bracket 76 and releasably locked therein by spring biased locking structure (not shown) within the bracket 76 or, alternatively, by interference fit (that is, by frictional engagement). Alternatively, the interengagable structure may be provided with a downwardly projecting structure (not shown) that can be received in the upper end of the tubular structure 82.

The support member 60 includes a pair of grooves 88 molded in the plastic material. The grooves 88 allow the support structure 14 to be press fit into releasable engagement with the extended transport handle 24 for storage and transport of the support structure 14 when the workbench 10 is in its storage position.

Operation

Generally, when the workbench 10 is described as being in its "storage position", this refers to the configuration of the workbench 10 in which the upper work structure 16 is releasably secured to the base structure 12. When the workbench 10 is in its storage position, the workbench 10 can be used either 1) to transport the tools contained in the storage space or 2) to support a workpiece. When the workbench 10 is used to transport the stored tools, the base structure 12 is lifted off of the ground using the transport handle 24 so that only the wheels 22 are in contact with the ground surface (see FIGS. 6). This position is generally referred to as the "storage transport position" of the workbench 10. When the workbench 10 is used to support a workpiece, the base structure 12 is placed on a ground surface (the ground surface is not shown in the figures) so that it is in the position or orientation generally shown in FIG. 2. This position is generally referred to as the "storage operative position" of the workbench". The workbench can be used to support a workpiece while the upper work structure 16 is latched to the base structure 12 (FIG. 2) or when the upper work structure 16 is unlatched from and space above the base structure 12 (by the support structure 14 as shown in FIG. 3). These two operative positions are designated the "storage operative position" and the "extended operative position", respectively, to facilitate discussion.

The operation of the upper work structure 16 to support and/or clamp a workpiece is essentially the same whether the workbench 10 is in its storage operative position or its extended operative position. Therefore, only the operation of the workbench 10 in its extended operative position will be considered in detail. It can be understood, however, that the discussion applies equally to the operation of the workbench 10 in its storage operative position.

The workbench 10 can be easily transported in its storage position by moving the transport handle 24 to its extended position and lifting the central grippable portion 37 upwardly to pivot a flat bottom portion 99 of the base structure 12 out of contact with a ground surface supporting the workbench 10 so that only the wheels 22 are in contact with the ground surface. The user can then push or pull on the handle 24 to roll and steer the workbench 10 easily to and from a work site. When the user lowers the base structure 12 so that the flat bottom surface 99 of the base structure 12 is again in contact with the ground surface, the flat bottom 99 is essentially flush with the ground surface (assuming the ground surface is level and flat) to stabily support the workbench 10. Preferably the wheels 22 are vertically spaced above the ground surface when the base structure 12 is in its storage operative position to promote stability in the storage operative position.

To convert the workbench 10 from the storage position to the extended operative position, the user unlatches each latch 52 by pulling each latch 52 out of engagement with the respective lock engaging structure 56 on the upper work structure 16 and removes the upper work structure 16 from the base structure 12 using the central handle 58. The user removes the tool holding tray 40 from the storage space 15 (whether the base structure 12 is constructed such that the tray 40 is mounted on the edge 45 has shown in the figures or is received entirely within the compartment 20) using the tray handle 50, and also removes the support structure 14 from the storage compartment 20 of the base structure 12 (in the instance in which the support structure 14 is stored inside the base structure 14) or removes the support structure 114 from engagement with the transport handle 24 (in the instance in which the support structure 14 is stored on the transport handle 24 as shown in FIG. 6).

The support structure 14 is stored in its closed retracted position (FIG. 4). The user moves the elongated support members 60, 62 of the support structure 14 apart, causing the upper and lower cross brace structures 70, 72 to unfold. The tool holding tray 40 is then mounted between the support members 60, 62 as shown in FIG. 3.

Specifically, to mount the tray 40 between the support members 60, 62, the support members 60, 62 are moved part until the cross brace structures 70, 72 are essentially straight and parallel to one another. The tool holding tray 40 is then slipped between the cross brace structures 70, 72. The recessed portions 100 on opposite ends of the tray 40 receive the support members 60, 62 as shown in FIG. 3. The support members 60, 62 are provided with integrally formed tray supporting structures 102 upon which the flange 41 can rest so as to mount the tool holding tray 40 on the support members 60, 62 when in the operative position. The tray supporting structures 102 and the tool holding tray 40 can optionally be molded such that the tray 40 can be press fit into engagement with each support member 60, 62 to more securely mount the tray 40 to the support structure 14. The tool holding tray 40 is mounted on one support member (such as the support members 60) and the other support member (such as the support members 62) is moved toward the tool holding tray 40. As the support member 62 moves inwardly toward the tray 40, the brackets 76, 78 on the upper and lower cross brace structures 70, 72, respectively, move toward one another and through opposite sides of the elongated opening 48 in the tray 40 into releasably locked interengagement so that the releasably interengagable structure 80 is disposed within the releasably interengagable structure 82 as aforesaid to releasably lock the structures 80, 82 together. It can be appreciated from FIG. 3 that the tray 40 and the cross brace structures 70, 72 hold the support members 60, 62 rigidly in spaced relation when the brackets 76, 78 are interengaged, and the tray 40 is supported by the support structures 102.

The support structure 14 is then mounted on the base structure 12 by pressing a plurality of outer teeth 104 integrally formed on opposite sides of the end portion 65 of each support member 60, 62 into recesses 106 (FIG. 1) of complementary configuration integrally formed in wall portions of the base structure 12 and by pressing a plurality of inner teeth 107 integrally formed on a central portion of the end portion 65 into a recess 111 formed on the exterior of the base structure 12 (see FIGS. 1 and 3, for example). The upper work structure 16 is then mounted on the support structure 14 by pressing recesses (not shown) integrally formed by wall portions 98 of the upper work structure 16 into engagement with a plurality of teeth 110 of complementary configuration integrally formed on the end portion 67 of each support member 60, 62 and then optionally latching the upper work structure 16 onto the support structure 14 with a pair of latches 152 (shown, for example, in FIG. 3 but not shown in FIG. 4 to more clearly illustrate portions of the support structure 14 in FIG. 4) pivotally mounted respectively on each support member 60, 62. The latch 152 latches the upper work structure 16 to the support structure 14 by latching onto the latch engaging structure 56 so as to hold the two structures 12, 16 securely together. The latches 152 are of similar construction and function to the latches 52 on the base structure except that the latches 152 do not include central apertures 57. The structures that are identical between latches 52 and 152 are designated by identical reference numbers and are not described further. It is within the scope of the invention to provide latching structure on the lower portion of each support member 60, 62 to allow the support members 60, 62 to be latched to the base structure when the workbench is in its operative position.

Figure 5:
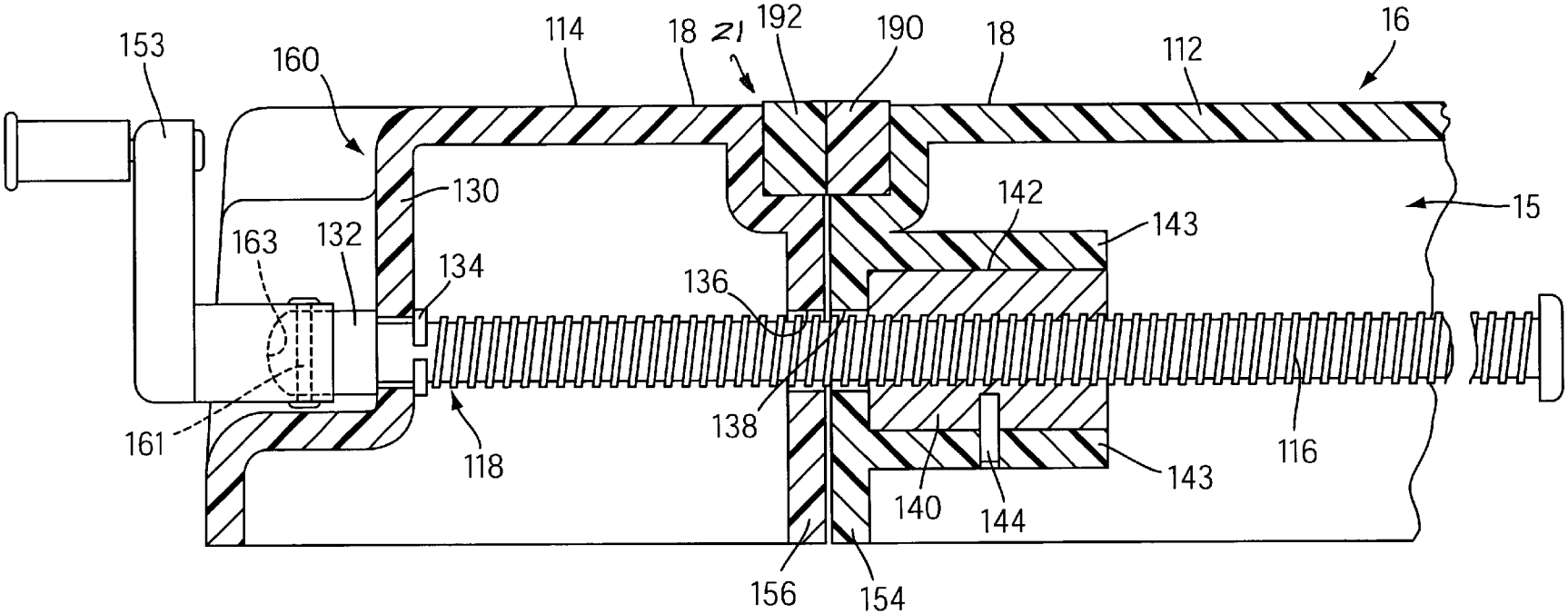
FIG. 5 is a cross-sectional view taken through the line 5—5 in FIG. 3.

As shown best in FIGS. 2, 3 and 5, the clamping assembly 21 of the upper work structure 16 includes a first work member 112 and second work member 114 mounted for a range of movement relative to one another on the support structure when the workbench is in the extended operative position (or on the base structure 12 when the workbench 10 is in its storage operative position as shown in FIG. 2; as mentioned above, the operation of the clamping assembly 21 will be discussed using the extended operative position as an example, but it is understood that clamping assembly 21 can be used to clamp and hold a workpiece when the workbench 10 is in its storage operative position of FIG. 2 as well). The work members 112, 114 are constructed and arranged for relative movement from an essentially closed position horizontally outwardly therefrom toward and into an open position so that a workpiece can be placed between the work members 112, 114. The workpiece can be releasably clamped between the members 112, 114 by closing the members 112, 114 on opposite sides of the workpiece using a threaded crank structure. In the exemplary embodiment of the workbench 10, the threaded crank structure is realized by a pair of threaded members described below.

In the embodiment of the workbench 10 shown in the figures, the first work member 112 is rigidly secured to the support structure 14 (see FIG. 3, for example) and the second work member 114 is mounted on the first work member 112 for relative movement with respect thereto between open and closed positions. When the workbench 10 is in its storage operative position, the first work member 112 is releaseably secured to the base structure 12 by the latches 52 and the second work member 114 is movable using the threaded crank structure toward and away from the first work member in a generally horizontal direction. As can be understood from the cross-sectional view of FIG. 5, the threaded crank structure of the upper work structure 16 includes a pair of elongated threaded members 116 that movably mount the second work member 114 on the first member 112. Only one threaded member 116 is shown in FIG. 5, but the structure and mounting of the other threaded member is identical and can be understood from this figure. Thus, the discussion of threaded member 116 and its representation in FIG. 5 applies to both threaded members.

Each elongated threaded member 116 has one end 118 rotatably mounted in an outer wall 130 of the second work member 114. The one end 118 of the threaded member 116 is rotatably mounted to the wall 130 between an enlarged end portion 132 of the threaded member 116 and a C-clamp structure or retaining washer 134 mounted on the threaded member 116. The end portion 132 and the C-clamp structure 134 allow rotation of the threaded member 116 with respect to the second work member 114, but prevent relative movement between the second work member 114 and the threaded member 116 in an axial direction (where "axial direction" refers to the direction defined by the axis of rotation of the threaded member 116).

The threaded member 116 extends outwardly of the second work member 114 through an aperture 136 and enters the first work member 112 through an axially aligned aperture 138. The threaded member 116 threadedly engages an internally threaded collar structure 140 in the first work member 112. The threaded collar structure 140 is preferably made of metal, but can be made of a plastic or any other suitable material, and preferably has an outer surface 142 that provides the structure 140 with a noncircular exterior cross-section. The noncircular surface 142 is held nonrotatably within an integral wall portion 143 of the first work member 112. A locking pin 144 extends through an opening in the wall portion 143 and into the threaded collar structure 140 to prevent movement of the threaded collar structure 140 outwardly of the wall portion 143 in the axial direction.

Rotation of the threaded members 116 moves both the threaded members and the second work member 114 as a unit in an axial direction with respect to the first work member 112 between the open and closed positions. Each threaded member has a rotation handle or crank handle 153 at the free end 118 thereof to rotate the threaded members. The work members 112, 114 have integral vertical wall portions 154, 156, respectively, that abuttingly engage a workpiece when the members 112, 114 are closed thereon and abuttingly engage one another when the members 112, 114 are in the closed position (as shown in FIG. 5). The wall portions 154, 156 thus provides clamping structure that defines opposed clamping surfaces which are movable toward and away from one another when the second work member is moved toward and away from the first work member. As can also be appreciated from FIG. 5, portions of the work surface 18 are provided by the first and second work members 112, 114 and these portions are generally coplanar.

The workbench 10 includes a plurality of workpiece holding members 147 (two of which are shown in FIGS. 1 and 3, for example). The members 147 are provided with workpiece gripping and engaging faces 149 that are suitable for engaging the vertical sides of a board or similarly shaped workpiece to hold the same on the work surface 18 of the upper work structure 16. Each member 147 can be removably installed in any of a plurality of openings 151 formed in the work surface 18 of the upper work structure 16 to allow the members 147 to be repositioned with respect to the first and second work members to accommodate workpieces of different sizes. The openings 151 are molded in the upper work structure 16 so as to extend inwardly of the work surface 18. The inwardly extending molded structure providing the openings 151 in the surface 18 is not shown in FIG. 5 to more clearly illustrate the threaded crank structure.

Each crank handle 153 is pivotally mounted by a pin 161 to the respective threaded member 116 for movement between folded and extended to positions. An arcuate notch 163 is provided in each rotation handle 153 to facilitate pivotal movement of the same between folded and extended positions. When the rotation handles 153 are in their folded positions, they are disposed within recesses 160 formed within the upper work structure 16 so that they do not project outwardly therefrom when the workbench 10 is in its storage position; and when the rotation handles 153 are in their extended positions, they project outwardly from upper work structure 16 so that the user can easily grasp and turn both handles 153 simultaneously to rotate the threaded members 116 to clamp or release a workpiece with the clamping assembly 21.

Optionally, inserts 190, 192 can be provided on the first and second work members 112 and 114, respectively, at the interface therebetween. The inserts 190, 192 can be constructed of a metal material, a rubber-like or composite-type of material, a plastic material or any other suitable material. The inserts 190, 192 improve the gripping ability of the workbench and also help to reduce wear at the interface between the first and second work members. It is also contemplated, however, that each work member 112, 114 be constructed entirely of a molded plastic.

It can be understood that when the workbench 10 is in its extended operative position (FIG. 3) or in its storage operative position (FIG. 2), the upper work surface 18 is constructed and arranged to support a workpiece. Furthermore, when the workbench 10 is in its extended operative position, hand tools and other hardware stored in the storage compartment 20 in the base structure 12 and in the tray 40 are easily accessible to the worker. Preferably, a tool holding assembly 164 (shown in FIG. 3, for example, but not shown in FIG. 4 to more clearly illustrate the support structure 14) is provided on the support member 60 to hold the user's handle tools. An identical holding assembly 164 can optionally be provided on the other support member 60 as well. The holding assembly 164 includes a holding member 166, preferably made of molded plastic, that is mounted for storage within a recess 168 molded into the respective support member 60. The holding member 166 includes two integral arm members 170. Each arm member 170 includes a pair of integral projecting portions 172 that are press fit into well structures 174 formed in the associated support member 60 to pivotally mount the holding members 166 to the support member. The holding member 136 is mounted for pivotal movement between 1) a folded position in which it is disposed for storage within the associated recess 168 and 2) an operative position (see FIG. 3) in which it extends essentially perpendicularly outwardly from the support member 60 to hold a hand tool, such as a portable electric drill.

It can be understood that the description of the structure and the operation of the workbench 10 is exemplary only and not intended to limit the use of the invention. For example, the tool holding tray 40 can be mounted as described and as shown in FIG. 3 or, alternatively, can be mounted in the upper interior recess 42 of the base structure 12 when the workbench is in its operative position, or cross-wise on the top of the base structure 12. As a third alternative, the tool holding tray 40 can be used as a separate, detached member separate from the workbench in its operative position so that the tray can, for example, be carried about the work site when the workbench is in use. It can thus be appreciated that the locking engagement of the upper and lower cross brace structures 70, 72 is alone sufficient to rigidly hold the support members 60, 62 in spaced relation while the workbench is in its operative position supporting a workpiece.

It can thus be understood that the tool holding tray 40 is constructed and arranged to be mounted in 1) an upper mounting position (see FIG. 3, for example) wherein it is mounted on the support structure 14 in vertically spaced relation above the base structure 12 when the workbench 10 is in its operative position or 2) a lower mounting position (not shown in the figures) wherein it rests upon the base structure 12 when mounted above the base structure 12 when the workbench is in its operative position.

The tool holding tray 40 is constructed and arranged to fit within the storage space 15 when the workbench 10 is in its storage position. The tray can also be mounted above the base structure 12 when the workbench 10 is in its operative position. Although the tool holding tray is provided with a central opening 48 constructed and arranged to receive the cross braces 70, 72 therethrough when the tool holding tray 40 is mounted in the upper mounting position (FIG. 3), it is not necessary for the tray 40 to be in his position when the workbench is in its operative position.

It should be appreciated that in the preferred embodiment, the base structure 12, the upper work structure 16, the wheels 22 and support members 60, 62 are each preferably molded entirely from a suitable plastic material. Thus, the workbench 10 is lightweight, which is particularly advantageous for transporting the workbench 10 when in the storage position.

It can also be appreciated that while the exemplary embodiment shows the support structure 14 stored in carrying relation with respect to the upper work structure and base structure in two positions (that is, either inside the storage space and on the transport handle, respectively) this is intended to be exemplary only and not intended to be limiting. For example, it is contemplated to store the support structure by removably mounting the same on the base structure, on the upper work structure, or both, when the workbench is in its storage position.

It can also be understood that while the invention has been embodied for illustration as a workbench suitable for use in home repair and in the construction trades, this embodiment is intended to illustrate the principles of the invention only and is not intended to limit the scope of the invention. It is, for example, contemplated to construct storage and work support assemblies having a wide range of structures and a wide range of sizes for use in a wide range of tasks and environments. For example, it is contemplated to provide an embodiment of the invention suitable for use as a makeup case. Cosmetics and utensils for applying cosmetics could be stored and carried, for example, in the storage space and tray assembly, and the upper work structure could be constructed to include a folding mirror (such as a three panel mirror) that can be deployed when the makeup case is in its operative position. It can also be understood that an embodiment of the workbench could easily be constructed for storing and serving food and beverages. For example, the base structure and upper work structure could formed parts of an insulated storage container suitable for use as an ice chest in the storage position. In the operative position, the work surface of the upper work structure could be constructed and arranged to prepare and serve food and beverages.

It will thus be seen that the objects of the present invention have been fully and effectively accomplished. It will be realized, however, that the foregoing specific embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A portable workbench, comprising:

a molded plastic base structure;

wheels rotably mounted on said base structure;

a transport handle connected to said base structure constructed and arranged to be manually engaged to move said base structure between a) a storage operative position wherein said base structure is stabily supported on a horizontal surface and b) a storage transport position wherein said wheels rollingly contact said horizontal surface so that said base structure can be moved along said horizontal surface using said handle;

a molded plastic upper work structure constructed and arranged to be supported on an upper portion of said base structure in a storage operative position, said upper work structure and said base structure cooperative when in the storage operative positions thereof to define a storage space;

releasable securing structure movable between a) a securing position wherein said upper work structure is fixedly secured to said base structure in the storage operative position thereof and b) a released position wherein said upper work structure can be moved with respect to said base structure from said storage operative position to allow access to said storage space; and said upper work structure defining a generally horizontal work surface when in the storage operative position thereof constructed and arranged to support a workpiece thereon, said upper work structure emboding therein a clamping assembly for clamping a workpiece in fixed relation with respect to said work surface.

2. A portable workbench according to claim 1 wherein said clamping assembly includes a first work member fixedly secured to said base structure by said releasable securing structure and a second work member mounted to said first work member for horizontal movement with respect thereto, and threaded crank structure constructed and arranged to move said second work member with respect to said first work member, said first and second work members having clamping structure defining opposed clamping surfaces movable toward and away from one another when said second work member is moved.

3. A portable workbench according to claim 2 wherein portions of said work surface are provided by said first and second work members, respectively, said respective portions being generally coplanar.

4. A portable workbench according to claim 3 wherein said threaded crank structure includes a pair of elongated threaded members, each threaded member having one end rotatably mounted in said second work member and each threaded member extending into and threadedly engaging said first work member such that rotation of said threaded members moves said second work member with respect to said first work member as aforesaid, each threaded member having a crank handle mounted on said one end thereof to rotate said threaded members.

5. A portable workbench according to claim 4 wherein each said crank handle is pivotally mounted for movement between a folded storage position wherein said crank handle is disposed in a respective crank handle recess formed in said second work member and an extended position wherein each said crank handle extends outwardly of the associated crank handle recess in a position to be grasped.

6. A portable workbench according to claim 5 wherein the wheels are mounted on one end of said base structure and said transport handle is mounted on an opposite end of said base structure.

7. A workbench according to claim 6 wherein said wheels are spaced from said horizontal surface when said base structure is in said storage operative position thereof to promote stability in said storage operative position.

8. A portable workbench according to claim 6 wherein said transport handle is movable between 1) a retracted storage position in which said transport handle does not protrude from said base structure in said storage operative position and 2) an extended operative position which allows said transport handle to be easily grasped, particularly when said base structure is in the storage transport position.

9. A portable workbench according to claim 8 wherein said transport handle is generally U-shaped having a pair of legs extending from opposite ends of a bight portion, a free end portion of each said leg being movably engaged with said base structure for transport handle movement between retracted and extended positions as aforesaid and an outer end portion of each leg extending upwardly to facilitate grasping the bight portion when the base structure is in the storage operative position.

10. A workbench according to claim 9 further comprising a carrying handle mounted to said first work member, said carrying handle being disposed in a recess in the work surface of said first work member and being movable between a) a manually engagable extended position wherein said carrying handle protrudes from said first work member above the work surface thereof to facilitate alternate manual carrying transport of said upper work structure and said base structure when secured thereto by said releasable securing structure and b) a retracted position wherein said carrying handle is disposed in said recess so as not to protrude from the work surface of said first work member when said upper work structure and said base structure are in said storage operative positions thereof.

11. A workbench according to claim 10, further comprising a tool holding tray constructed and arranged to fit within said storage space.

12. A workbench according to claim 11, wherein said tool holding tray is constructed and arranged to be supportingly mounted in an upper portion of said base structure.

13. A workbench according to claim 12 further comprising a plurality of workpiece holding members, each said holding member having a workpiece gripping face, each said work member having a plurality of openings extending inwardly of the work surface thereof, and each holding member being removably mounted in an opening so that said gripping faces extend perpendicularly upwardly from an associated work surface to grip a workpiece as said second work member is moved horizontally in a direction toward said first work member.

14. A portable workbench according to claim 12 further including support structure constructed and arranged to support said upper work structure on said base structure to allow reconfiguration between a) an extended operative position wherein said support structure mounts said upper work structure in vertically spaced relation to said base structure so that said work surface is disposed at a height which enables a user to comfortably work on a workpiece supported by said work surface while the user is standing, and b) said storage operative position wherein said upper work structure is secured to said base, said support structure being constructed and arranged to be carried in storing relation to said base structure.

15. A workbench according to claim 14 wherein said support structure is constructed and arranged to fit within said storage space so that said support structure can be carried in storing relation to said base structure within said storage space, said storage space being large enough to contain in addition to said support structure a plurality of hand tools for storage and transport.

16. A workbench according to claim 14 wherein said support structure is constructed and arranged to be removeably mounted to said transport handle when said transport handle is in its extended operative position so that said support structure can be carried in storing relation to said base structure by said extended transport handle.

17. A workbench according to claim 16, further comprising a tool holding tray constructed and arranged to fit within said storage space, and further constructed and arranged to be mounted above said base structure when said workbench is in said extended operative position.

* * * * *